US007099619B2

(12) United States Patent
Choi

(10) Patent No.: US 7,099,619 B2
(45) Date of Patent: Aug. 29, 2006

(54) AUTOMATIC DOCUMENT FEEDER

(75) Inventor: Dong-ha Choi, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/682,843

(22) Filed: Oct. 10, 2003

(65) Prior Publication Data

US 2004/0170456 A1 Sep. 2, 2004

(30) Foreign Application Priority Data

Dec. 24, 2002 (KR) ..... 10-2002-0083181

(51) Int. Cl.
*G03G 15/00* (2006.01)

(52) U.S. Cl. ..... 399/367; 399/365

(58) Field of Classification Search ..... 399/367, 399/377, 365, 361

See application file for complete search history.

(56) References Cited

U.S. PATENT DOCUMENTS 4,110,038 A * 8/1978 Irvine et al. ..... 355/50
5,022,639 A * 6/1991 DuBois ..... 271/3.2
5,080,344 A * 1/1992 Hayashi ..... 271/107
6,009,302 A * 12/1999 Worley et al. ..... 399/367
6,027,109 A * 2/2000 Wada et al. ..... 271/3.14
6,185,405 B1 * 2/2001 Sueoka ..... 399/367
6,321,064 B1 * 11/2001 Mizubata et al. ..... 399/370
6,603,950 B1 * 8/2003 Hamada et al. ..... 399/367
6,618,575 B1 * 9/2003 Takida et al. ..... 399/367
6,792,241 B1 * 9/2004 Nakagawa et al. ..... 399/367

FOREIGN PATENT DOCUMENTS

KR 2001-58632 7/2001

* cited by examiner

*Primary Examiner*—Anthony Nguyen
(74) *Attorney, Agent, or Firm*—Staas & Halsey LLP

(57) ABSTRACT

An automatic document feeder (ADF) including a platen cover which covers a copying region, a document tray which is provided on the platen cover and on which a document fed to the copying region is stacked, a pickup assembly which includes a pickup roller that picks up the document stacked on the document tray and transfers the document to a feed path, and a feeding roller that receives the document picked-up by the pickup roller and allows the document to enter the feed path and which pivots the pickup roller centering on a shaft of the feeding roller by a predetermined distance according to a rotating direction of the shaft of the feeding roller, and a pad holder which is installed in a pad holder groove formed at a region corresponding to the feeding roller in the tray and supports a frictional pad installed to contact the feeding roller.

18 Claims, 11 Drawing Sheets

AUTOMATIC DOCUMENT FEEDER

CROSS-REFERENCE TO RELATED APPLICATIONS

This application claims the priority of Korean Patent Application No. 2002-83181, filed on Dec. 24, 2002, in the Korean Intellectual Property Office, the disclosure of which is incorporated herein in its entirety by reference.

BACKGROUND OF THE INVENTION

1. Field of the Invention

The present invention relates to an automatic document feeder (ADF), and more particularly, to an ADF capable of transferring a document to a region where the document is to be scanned, in a multifunctional device to perform functions of a facsimile, scanner, and printer.

2. Description of the Related Art

An automatic document feeder (ADF) is provided in a multifunctional device having a copying function, such as a copier or a facsimile. By providing an ADF, when a multi-sheet document is to be copied, a document sheet can be automatically fed without repeatedly opening and closing the cover in a copying region so that continuous copying can be done; thus, remarkably reducing copying time.

FIG. 1 is a partial perspective view schematically illustrating the structure of a multifunctional device on which a conventional automatic document feeder (ADF) is mounted, and FIG. 2 is a side cross-sectional view to explain a feeding step performed by the ADF shown in FIG. 1.

Referring to FIGS. 1 and 2, the conventional ADF includes a tray 11, on which documents D to be fed into a multifunctional device 10 are stacked, and a pickup roller 12 which draws out a sheet of document D stacked on the tray 11 to enter the multifunctional device 10. The ADF is employed to feed documents.

As shown in FIG. 2, when the pickup roller 12 is rotated by driving a motor 13, the topmost sheet of a stack of sheets, which contacts the pickup roller 12, on the tray 11 is fed into the multifunctional device 10. Reference numeral 14 denotes a cover to protect the pickup roller 12 and an entrance of the multifunctional device 10 into which the document D is fed. The cover 14 is in a closed state, as shown in FIG. 2, during a printing operation.

Meanwhile, in the above structure, a front end of the document D has to be placed well under the pickup roller 12 when the document D is stacked on the tray 11 so that the document D is smoothly fed into the multifunctional device 10. However, when a document containing too many sheets is stacked on the tray 11, it is difficult to place the front end of the document D under the pickup roller 12. Thus, a document having a maximum of 20 sheets can be stacked on the tray 11 at one time. This causes inconvenience for a user in that the user has to stack documents on the tray 11 several times when the document to be printed has a large number of sheets. In addition, in the above structure, the slant of the tray 11 toward the pickup roller 12 is set as steep as possible such that the documents are smoothly slid under the pickup roller 12. Thus, the height of the multifunctional device 10 becomes larger as much, and a large space to install the multifunctional device 10 is needed, and double feeding of the document occurs.

FIG. 3 is a side cross-sectional view of a feeding apparatus disclosed in Korean Patent Publication No. 2001-58632, and FIG. 4 is an exploded perspective view of a frictional member and a pad holder of FIG. 3.

Referring to FIGS. 3 and 4, the feeding apparatus includes a frame 51 provided on a main body of a printer, a pad holder 60 which is hinge-coupled in an intermediate region of the frame 51 and elastically biased upwardly, a pickup roller 50 which is installed to contact the upper portion of the pad holder 60, and a knock-up plate 80 which is fixed on the frame 51 and supports one end of paper P to contact the pickup roller 50.

The pad holder 60 includes a body 61 at one side of which a hinge-coupling portion 64 is formed, and a saddle portion 62 on which a frictional member 63 is mounted. An insertion hole 75, a support protrusion 74, and a coupling hole 69 are formed in the body 61 of the pad holder 60. The saddle portion 62 includes an insertion protrusion 77, a support groove 76, and a hook 73 in which a hanging jaw 73*a* is formed. A support plate 78 which supports upper and rear sides of the pad holder 60 through a long hole 65 and fixes the frictional pad 63 and the saddle portion 62 to the body 61, is arranged. In addition, a protrusion 66 is formed at a rear side of the body 61, and an elastic spring 71 is connected to the protrusion 66, such that the pad holder 60 is elastically biased upwardly.

In the feeding apparatus having the above structure, a sheet of a document that contacts the pickup roller 50 by the rotation of the pickup roller 50 is picked-up and fed to a feed path. And, double feeding is prevented by a friction force of the friction pad 63.

In order to replace the frictional pad 63 with another one, a user removes the pickup roller 50 from the printer, and then, presses a protrusion 68 by about 1.5–2.0 mm by hand. Then, the coupling hole 69 is moved to the right sides of FIGS. 3 and 4, and the locked state of the hook 73 hung by the hanging jaw 73*a* in the coupling hole 69 is released. If the protrusion 68 is continuously pressed, a body of the saddle portion 62 is slid along a slanted surface of a rib 72 and is naturally lifted. Thereafter, the support plate 78 which clips the frictional pad 63, is lifted, and the frictional pad 63 mounted on the saddle portion 62 is removed, and a new frictional pad 63 is mounted on the saddle portion 62 and assembled for use.

However, the structure of the pad holder 60 is complicated. If the support plate 78 is deformed due to long-term use, the frictional pad 63 is not fixedly mounted on the saddle portion 62, and it is not easy for the user to dismantle the pickup roller 50 and replace the frictional pad 63 with another one.

SUMMARY OF THE INVENTION

The present invention provides an automatic document feeder (ADF) which enables easy replacement of a frictional member with another one and prevents double feeding.

According to an aspect of the present invention, there is provided an automatic document feeder comprising: a platen cover which covers a copying region; a document tray which is provided on the platen cover and on which a document fed to the copying region is stacked; a pickup assembly which includes a pickup roller that picks up the document stacked on the document tray and transfers the document to a feed path, and a feeding roller that receives the document picked-up by the pickup roller and allows the document to enter the feed path and which pivots the pickup roller centering on a shaft of the feeding roller by a predetermined distance according to a rotating direction of the shaft of the feeding roller; and a pad holder which is installed in a pad holder groove formed at a region corresponding to the feeding roller in the tray and supports a frictional pad installed to contact the feeding roller. An opposite portion of the pad holder to a portion contacting the frictional member is hinge-coupled to the pad holder groove, and an elastic spring is installed between a rear side of the pad holder of a side contacting the frictional member and the pad holder groove to elastically support, or bias, the frictional member towards the feeding roller.

In an aspect of the invention, a hanging protrusion is formed on a front end of the pad holder, and a pivoting position of the hanging protrusion is regulated upwardly by a hanging jaw formed in a portion of the pad holder groove corresponding to the hanging protrusion.

In an aspect of the invention, the hinge-coupling is performed by a hinge protrusion formed at both sides of a rear end of the pad holder and a hinge groove formed at a side corresponding to the hinge protrusion.

In an aspect of the invention, a tension part is formed at both sides of the pad holder, and the hinge protrusion is formed on the outward surface of the tension par.

Meanwhile, in an aspect of the invention, a slanted part which guides the picked-up document to enter between the frictional member and the feeding roller, is formed at the pad holder, and a plastic sheet is installed on the surface of the slanted part.

In an aspect of the invention, the automatic document feeder further comprises bushings which are installed at both sides of the shaft of the feeding roller; and support grooves to support the bushings. At least one bushing has a D-type cut, the D-type cut enters only in a lengthwise direction into the corresponding support groove, and the D-type cut is locked inside the support groove when the D-type cut is rotated.

Additional and/or other aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the preferred embodiments taken in conjunction with the accompanying drawings in which.

DETAILED DESCRIPTION OF THE PREFERRED EMBODIMENTS

Figure 1:
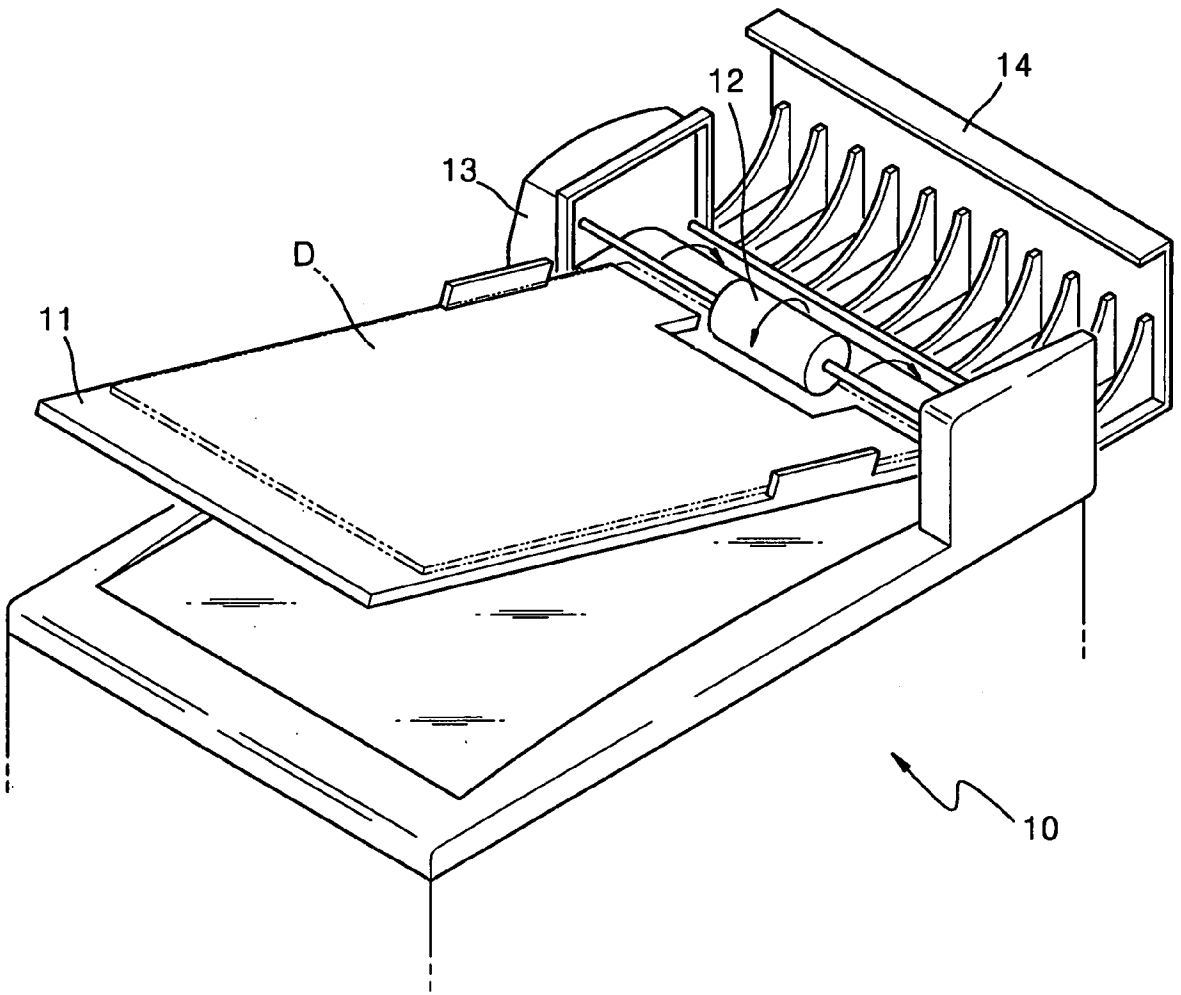
FIG. 1 (PRIOR ART)
FIG. 1 is a partial perspective view schematically illustrating the structure of a multifunctional device on which a conventional automatic document feeder (ADF) is mounted.
Figure 2:
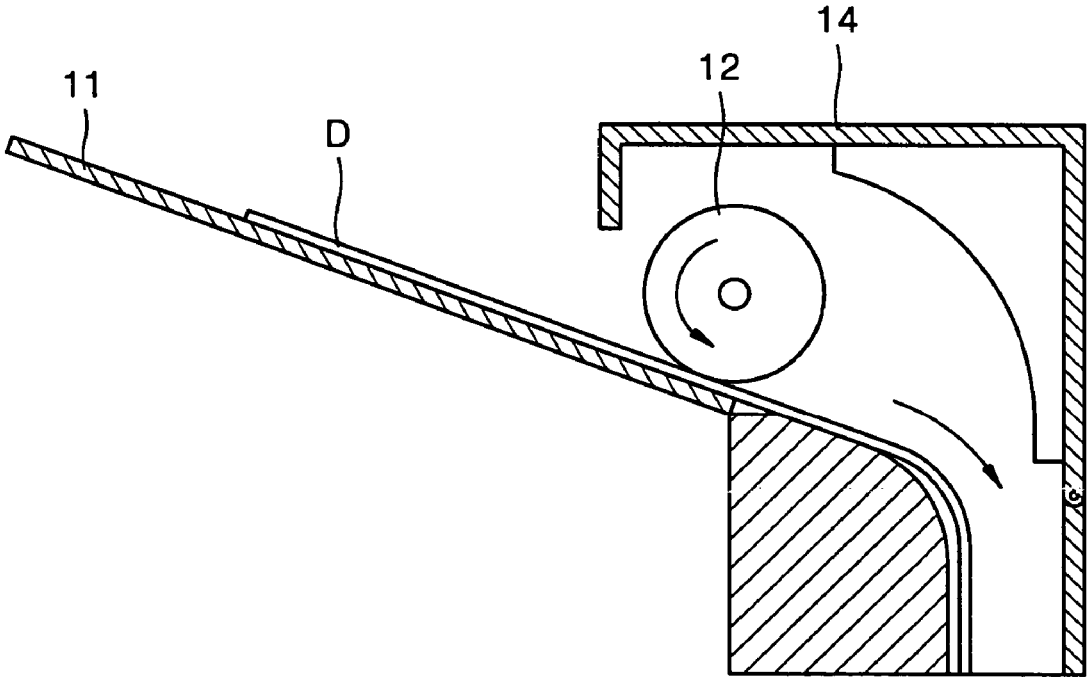
FIG. 2 (PRIOR ART)
FIG. 2 is a side cross-sectional view to explain a feeding step performed by the ADF shown in FIG. 1.
Figure 3:
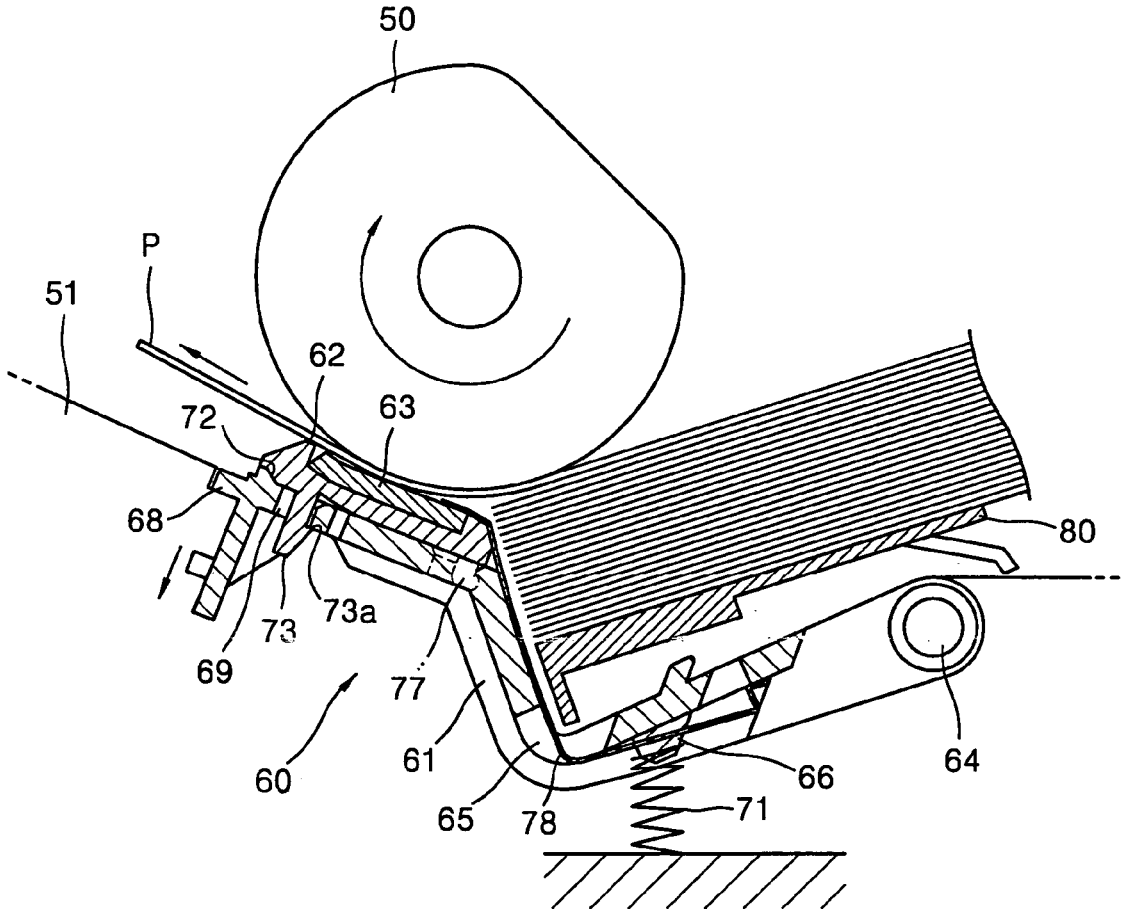
FIG. 3 (PRIOR ART)
FIG. 3 is a side cross-sectional view of a feeding apparatus disclosed in Korean Patent Publication No. 2001-58632.
Figure 4:
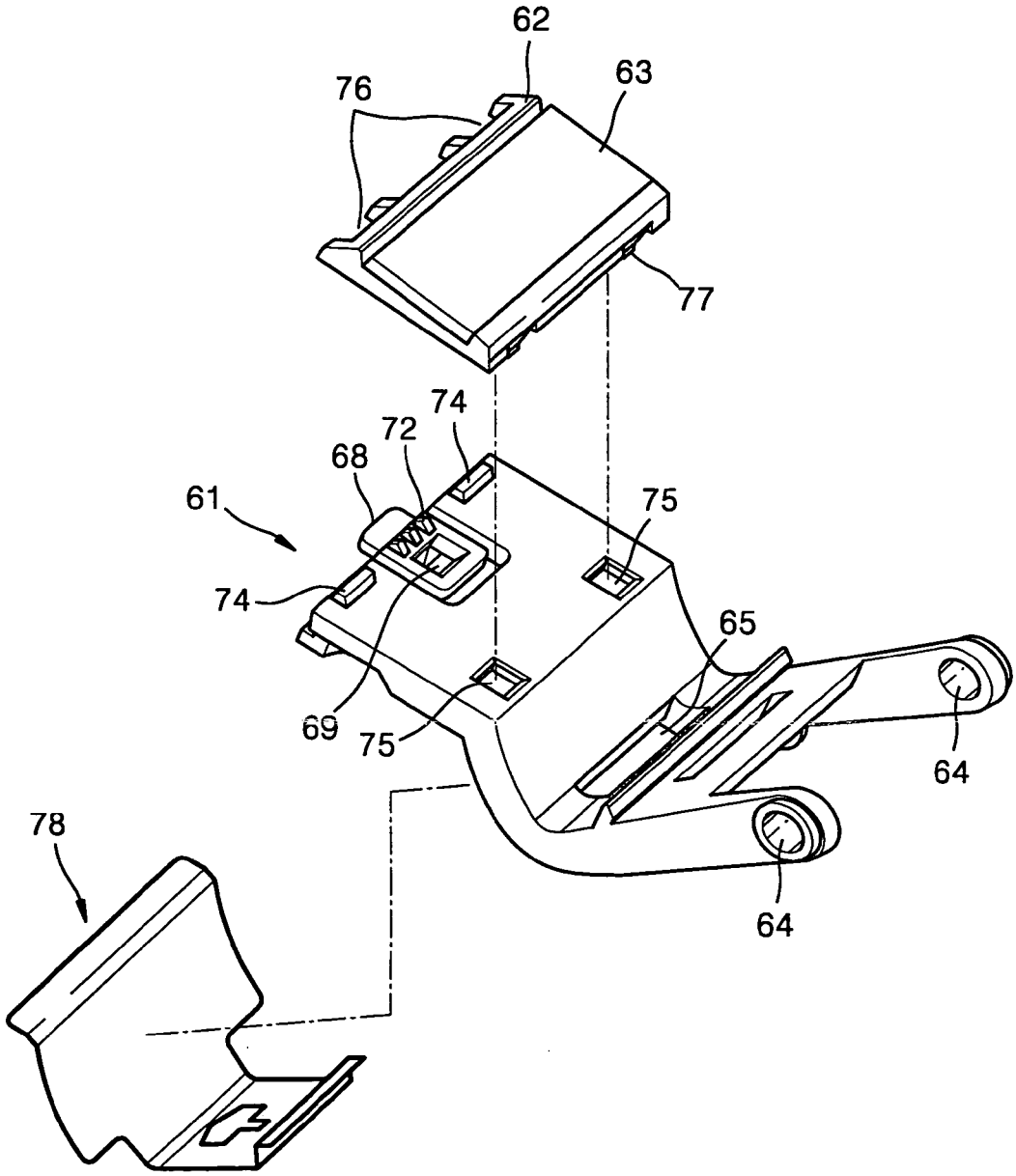
FIG. 4 (PRIOR ART)
FIG. 4 is an exploded perspective view of a frictional member and a pad holder of FIG. 3.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Figure 5:
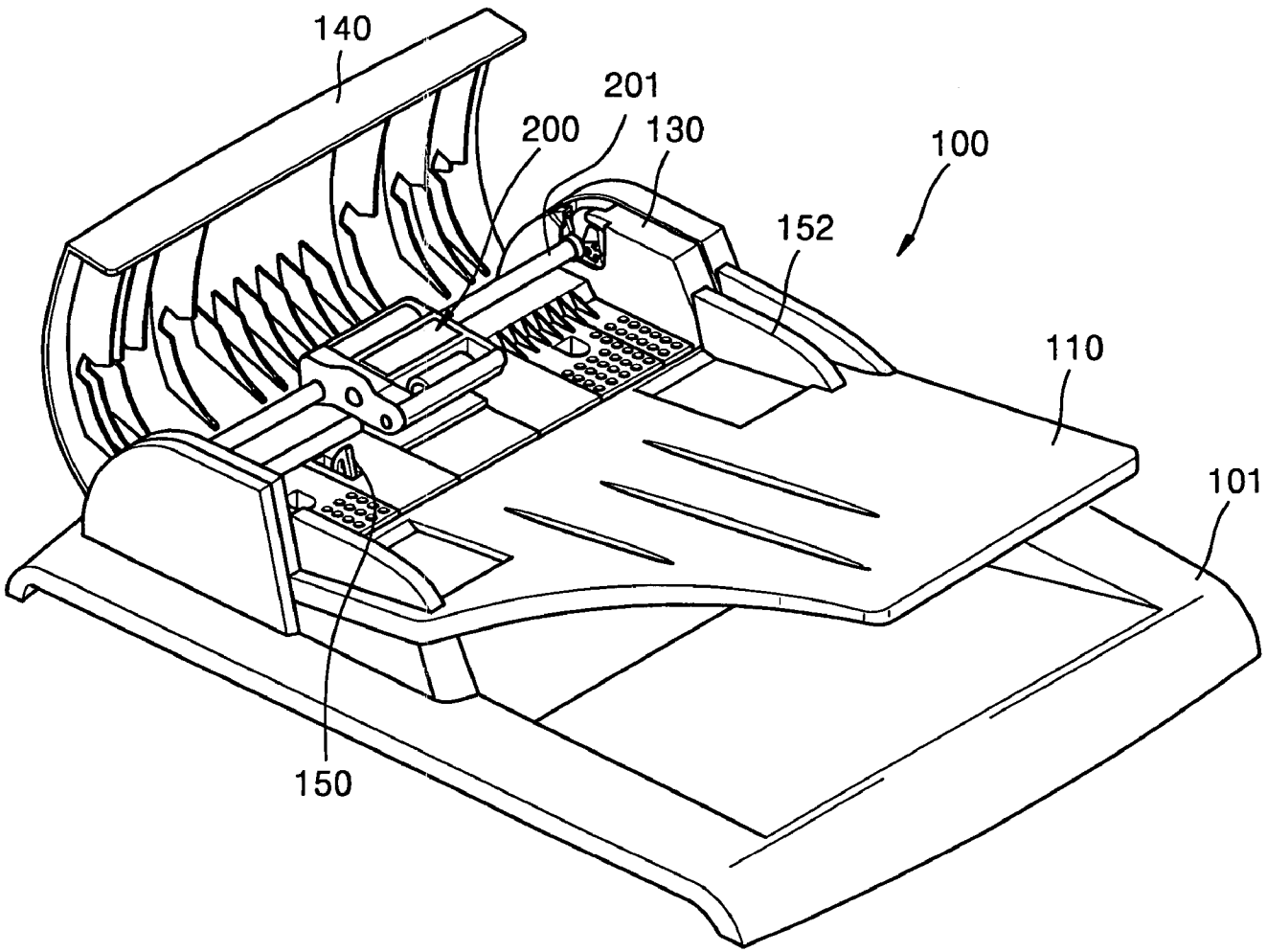
FIG. 5 is a perspective view of an automatic document feeder (ADF) according to an embodiment of the present invention.
Figure 6:
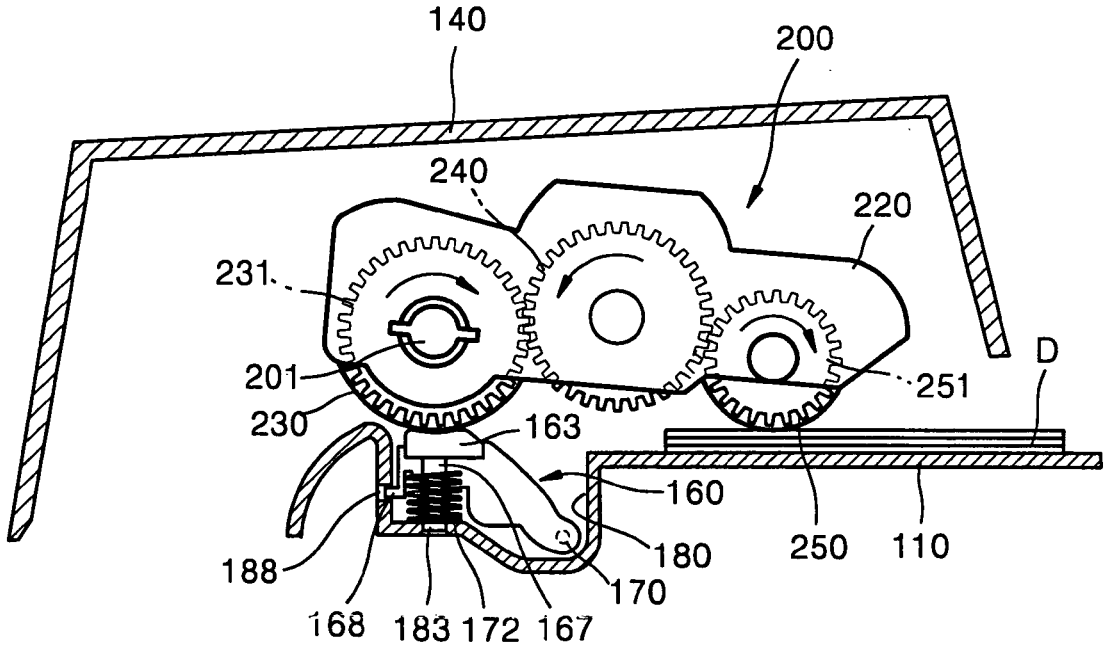
FIG. 6 is a partial side cross-sectional view of a portion where a pickup assembly and a frictional member of FIG. 5 are installed.

FIG. 5 is a perspective view of an automatic document feeder (ADF) 100 according to an embodiment of the present invention, and FIG. 6 is a partial side cross-sectional view of a portion where a pickup assembly 200 and a frictional member of FIG. 5 are installed.

Referring to FIGS. 5 and 6, an ADF 100 includes a platen cover 101 which covers a copying region of a multifunctional device, a document tray 110 on which documents D are stacked, and a pickup assembly 200 which is driven by a driving source 130 and allows the document D to enter the copying region inside the multifunctional device. Reference numeral 140 denotes a cover which covers a region including the pickup assembly 200. The cover 140 is used in a closed state and opened for maintenance. Reference numeral 150 denotes a sensor which detects a stack of documents, and reference numeral 152 denotes a document guide which regulates the width of documents to be fed.

As shown in FIG. 6, the pickup assembly 200 includes a pickup roller 250 which selectively contacts the document D stacked on the document tray 110 and a feeding roller 230 which receives the document D picked-up and transferred to a document feed path and transfers the document D to a copying region. A pad holder 160 having a frictional pad 163 is arranged under the feeding roller 230. The pad holder 160 is hinge-coupled to a pad holder groove 180 formed in the document tray 110, and a lower portion of the pad holder 160 is connected to an elastic spring (or a biasing member) 172 and elastically biased upward. In addition, a hanging protrusion 168 is formed on a front end of the pad holder 160, and a hanging groove 188 which locks the hanging protrusion 168 is formed in the pad holder groove 180, and this locking structure regulates a pivoting force of the pad holder 160 caused by an elastic force. Meanwhile, gears 231 and 251 are connected to the feeding roller 230 and the pickup roller 250, and a relay gear 240 is arranged between the gears 231 and 251 to connect power therebetween.

Figure 7:
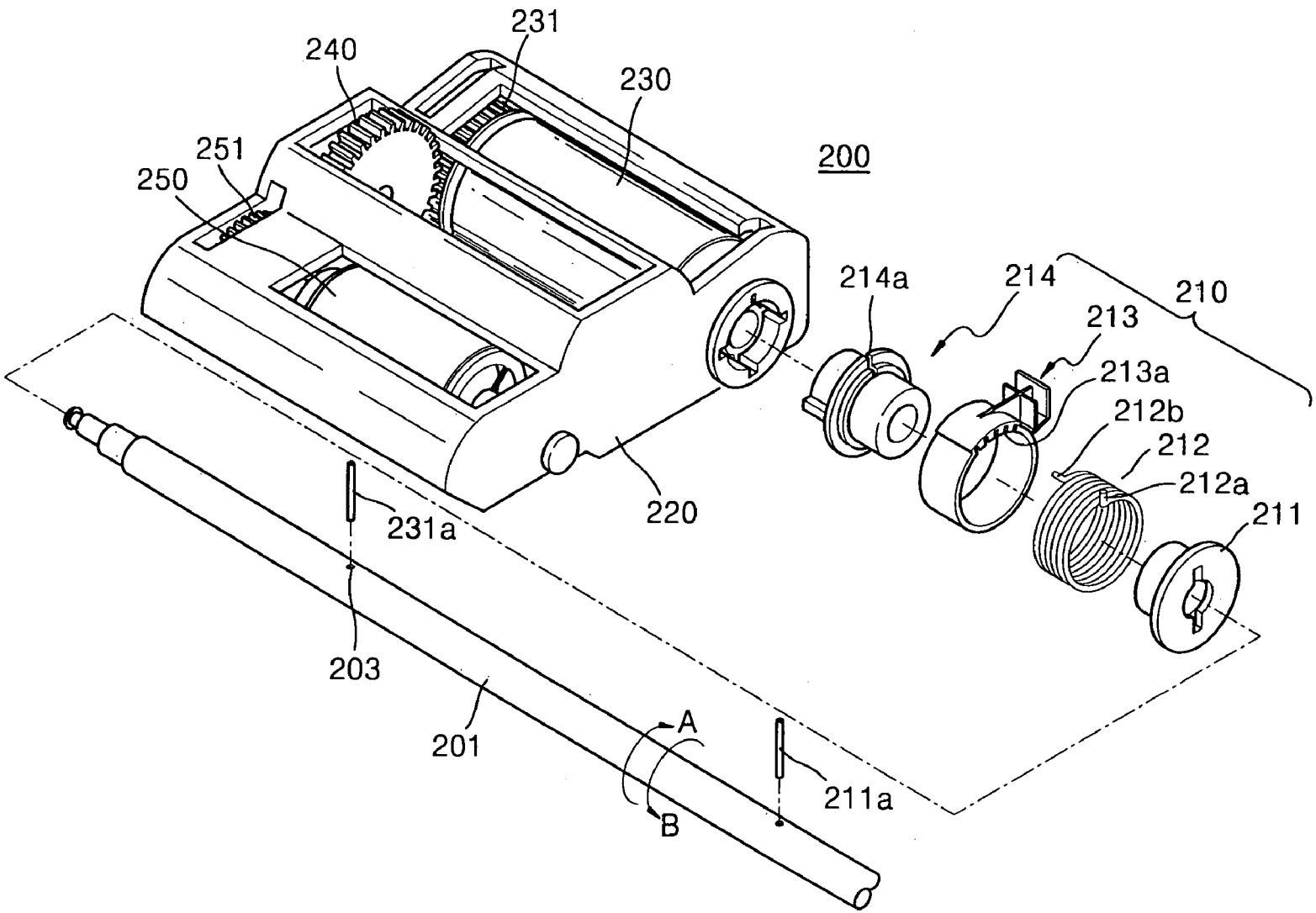
FIG. 7 is an exploded perspective view of the pickup assembly of FIG. 5.
Figure 8:
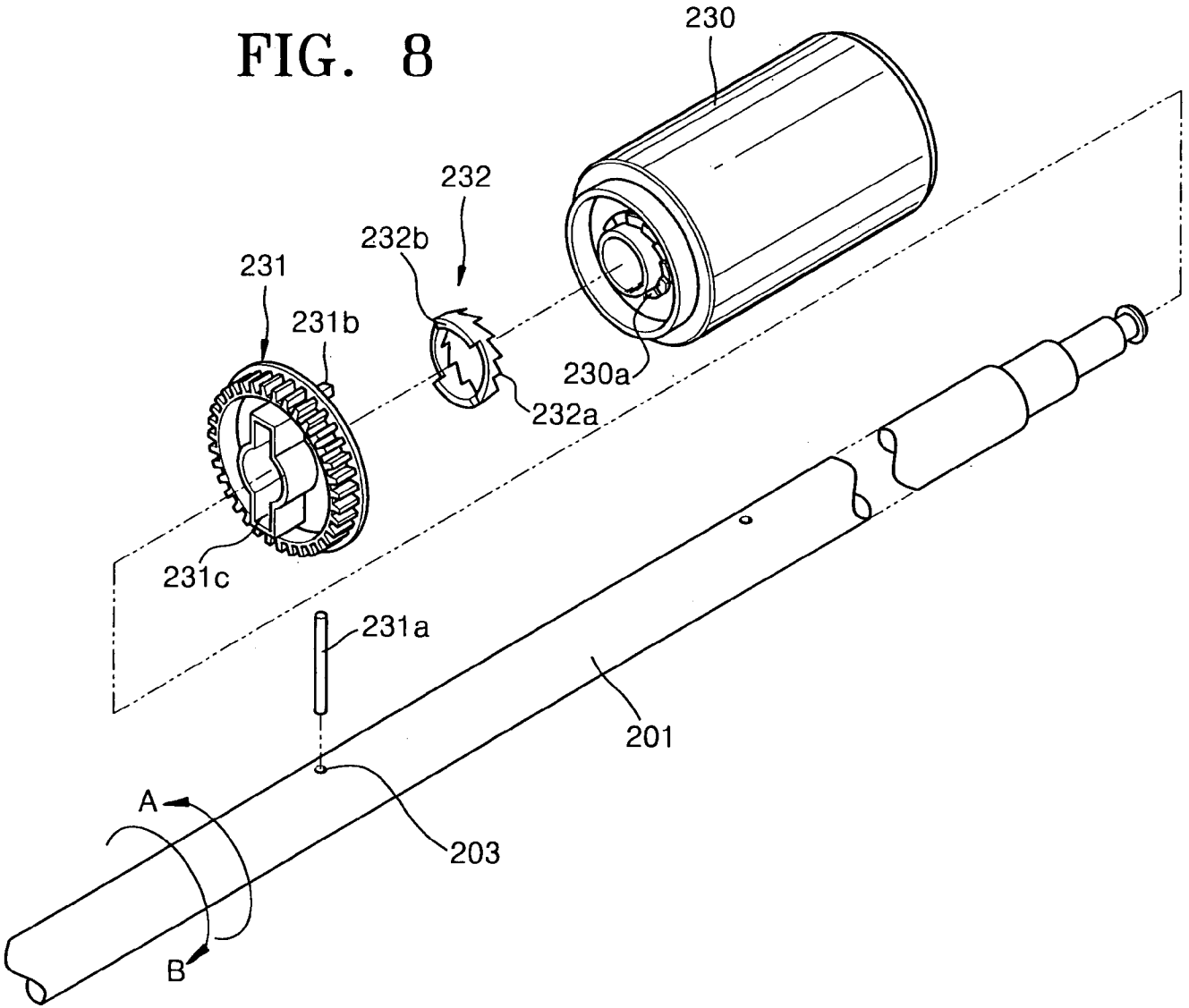
FIG. 8 is an exploded perspective view of a power connection unit of a feeding roller.
Figure 9:
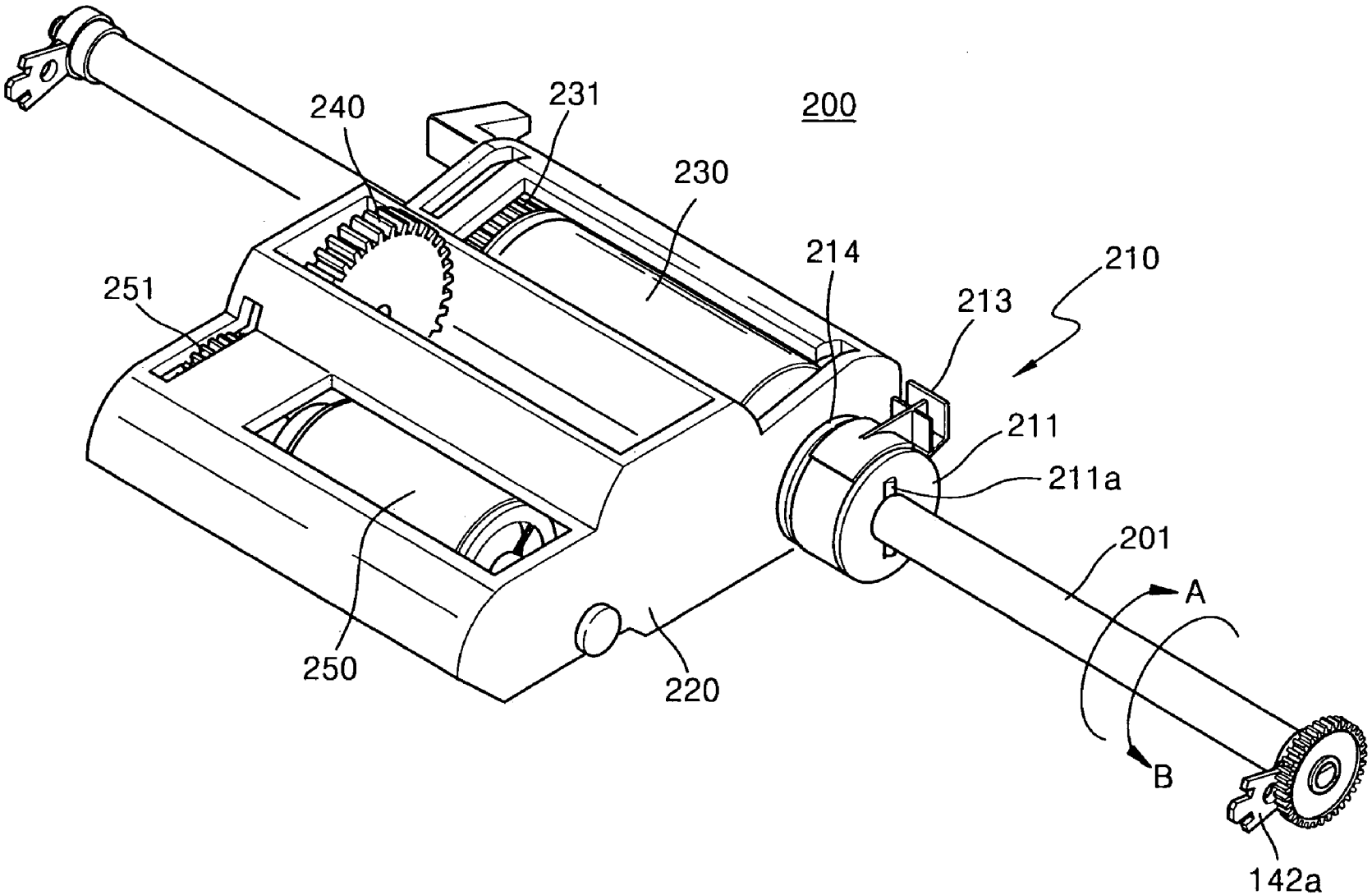
FIG. 9 is a combined perspective view of a pickup assembly of FIG. 7.

FIG. 7 is an exploded perspective view of the pickup assembly 200 of FIG. 5, FIG. 8 is an exploded perspective view of a power connection unit of the feeding roller 230, and FIG. 9 is a combined perspective view of the pickup assembly 200 of FIG. 7.

As shown in FIG. 7, the pickup assembly 200 includes a shaft 201 connected to a driving source (130 of FIG. 5), a feeding roller 230 installed to be coaxial with the shaft 201, a pivoting member 220 pivotably installed centering on the shaft 201, a pickup roller 250 rotatably installed at a free end of the pivoting member 220, and a relay gear 240 which connects the feeding roller 230 to the pickup roller 250. Here, when there is no lifting force, the pivoting member 220 is pivoted by its weight in a direction where the pickup roller 250 contacts the document D on the tray 110.

Reference numeral 210 denotes a clutch unit which selectively lifts the pivoting member 220 according to a rotating direction of the shaft 201. When the shaft 201 is rotated in a feeding direction of the pickup roller 250, i.e., in a direction (direction B) where the document D enters the copying region inside the multifunctional device, the clutch unit 210 disconnects power between the shaft 201 and the pivoting member 220 such that the pivoting member 220 is moved downwardly by its weight. When the shaft 201 is rotated in an opposite direction (direction A), the clutch unit 210 connects power between the shaft 201 and the pivoting member 220 such that the pivoting member 220 is lifted by the rotation of the shaft 201. As shown in FIG. 7, the clutch unit 210 includes a coupling member 214 coupled on a pivoting shaft of the pivoting member 220, a bushing 213 inserted on an outer circumference of the coupling member 214, a clutch spring 212, one end 212*a* of which is coupled to a coupling groove 213*a* of the bushing 213 and the other end 212*b* of which is coupled to a coupling groove 214*a* of the coupling member 214, and a driving member 211 which is fixed to the shaft 201 by a fixed pin 211*a* and frictionally contacts an inner circumference of the clutch spring 212.

As described above, the inner circumference of the clutch spring 212 contacts the driving member 211, and an outer circumference thereof contacts an inner circumference of the bushing 213. Thus, when the shaft 201 is rotated in direction A indicated by an arrow, the driving member 211 is also rotated in direction A and rotates and winds the clutch spring 212 by a friction force between the driving member 211 and the clutch spring 212. Then, the driving member 211, the clutch spring 212, and the bushing 213 are rotated together by friction, the coupling member 214, connected to the bushing 213 by the end 212*b* of the clutch spring 212, is also rotated. As a result, the pivoting member 220 is pivoted. Thus, the pivoting member 220 is rotated while the pickup roller 250 is lifted from the tray 110. Even though the rotation of the shaft 201 stops in this state, the pivoting member 220 is maintained in this rotation state unless a friction force between the driving member 211, the clutch spring 212, and the bushing 213 is not released. In this state, if the shaft 201 is rotated in direction B opposite to direction A, the driving member 211 is rotated in direction B. In the direction B, the clutch spring 212 is loosened. Thus, the friction force between the driving member 211 and the clutch spring 212 used to lift the pivoting member 220 is released. As a result, the pivoting member 220 is returned to their original positions by the weight of the pivoting member 220. Thus, the pickup roller 250 contacts the document D on the tray 110. Subsequently, if the shaft 201 is continuously rotated in direction B, the feeding roller 230 and the pickup roller 250 are rotated, and the document D enters into the feed path.

FIG. 8 illustrates a power connection unit with the shaft 201 which selectively rotates the feeding roller 230. As shown in FIG. 8, a slot 231*c* into which a fixed pin 231*a* is inserted is formed in a gear 231. The fixed pin 231*a* is inserted in a coupling hole 203 formed in the shaft 201 and inserted into the slot 231*c*. Thus, if the shaft 201 is rotated, the gear 231 is also rotated. A step surface 230*a* like a vane is formed on one end of the feeding roller 230, and a saw tooth member 232 having a saw tooth part 232*a* engaged with the step surface 230*a* is installed between the step surface 230*a* and the gear 231. An interference piece 232*b* is provided on the saw tooth member 232, and an interference protrusion 231*b* that interferes with the interference piece 232*b* is provided on the gear 231. As such, when the gear 231 is rotated, the interference protrusion 231*b* is caught on the interference piece 232*b* and thus, the saw tooth member 232 is rotated. In the above structure, when the shaft 201 is rotated in an arrow direction B, and the gear 231 and the saw tooth member 232 are rotated in direction B, a vertical surface of the saw tooth part 232*a* is engaged with a vertical surface of the step surface 230*a*. Thus, the feeding roller 230 is also rotated in a rotating direction of the shaft 201. However, when the shaft 201 is rotated in direction A opposite to direction B, since a slanted surface of the saw tooth part 232*a* and a slanted surface of the step surface 230*a* slide over each other, the feeding roller 230 is not rotated. Thus, when the shaft 201 is rotated in direction A, the pivoting member 220 is rotated in the state where the feeding roller 230 is stopped, and when the shaft 201 is rotated in direction B, the pivoting member 220 is returned to its original position, and the feeding roller 230 is rotated in the feeding direction.

Meanwhile, since the pickup roller 250 is gear-coupled to the feeding roller 230 and rotated, the pickup roller 250 does not need the above structure. However, for safer regulation of the rotating direction, the above-described power connection unit may be installed at the pickup roller 250, like in the feeding roller 230, so that the pickup roller 250 is rotated only when the shaft 201 is rotated in direction B.

Therefore, if the shaft 201 is rotated in direction B, the clutch unit 210 disconnects power connection between the shaft 201 and the pivoting member 220, and thus, the pickup roller 250 contacts the document D on the tray 110. The feeding roller 230 is rotated in direction B as the saw tooth member 232 is engaged with the step surface 230*a* and rotated. Thus, the pickup roller 250 connected to the feeding roller 230 and the relay gear 240 is also rotated in direction B and enters the document D into the multifunctional device.

Meanwhile, if the document D stacked on the tray 110 is exhausted, the sensor (150 of FIG. 5) senses this exhaustion. As such, the driving source 130 rotates the shaft 201 in direction A. If so, the driving member 211, the clutch spring 212, and the bushing 213 of the clutch unit 210 are rotated by the friction force, and the pivoting member 220 coupled to the coupling member 214 is pivoted. Thus, the pickup roller 250 is lifted from the tray 110. In this case, the feeding roller 230 and the pickup roller 250 are not rotated. After that, a feeding operation can be performed by rotating the pivoting member 220.

Figure 10:
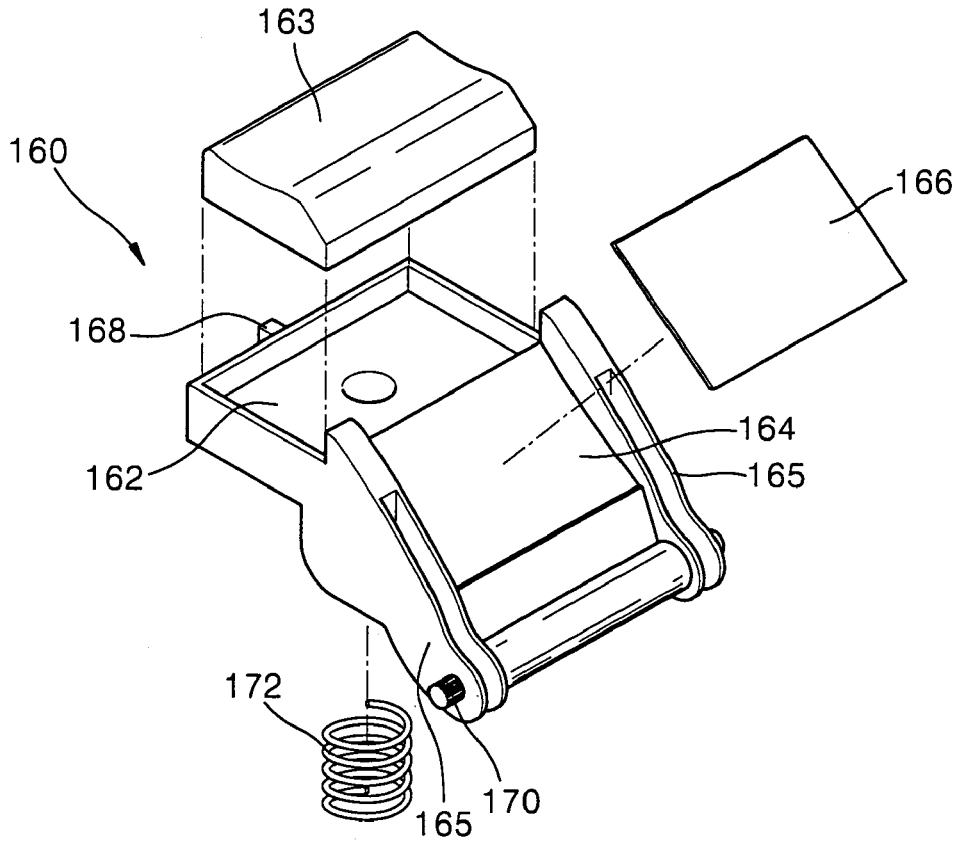
FIG. 10 is an exploded perspective view of a pad holder including a frictional pad according to an embodiment of the present invention.
Figure 11:
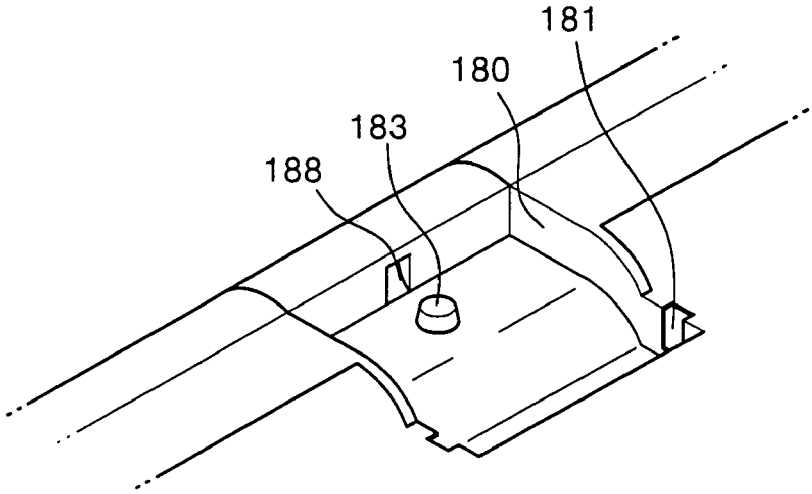
FIG. 11 is a perspective view illustrating an inside of a groove where the pad holder of FIG.10 is inserted.
Figure 12:
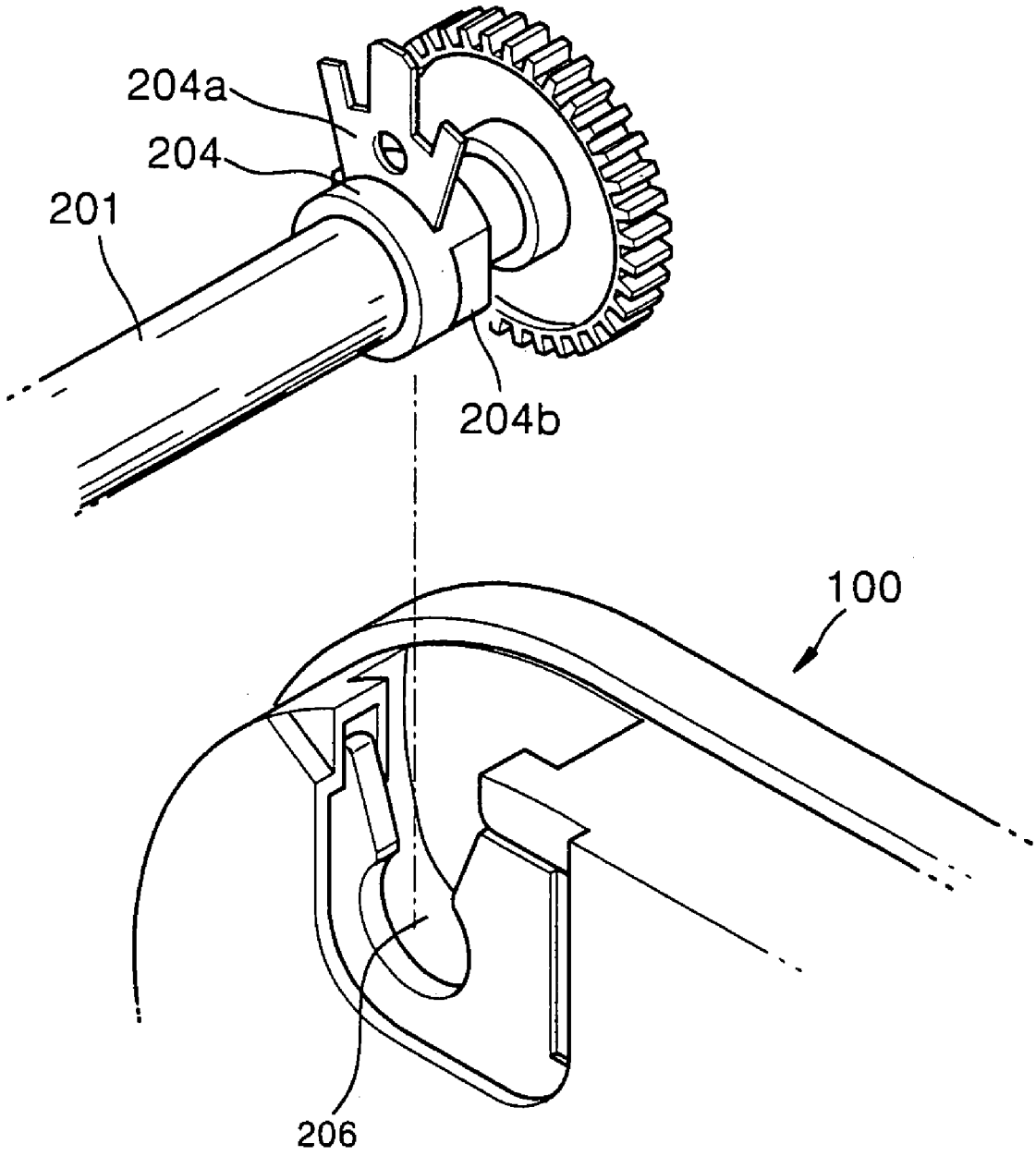
FIG. 12 is a perspective view illustrating the structure of the groove where a shaft of FIG. 5 is supported.

FIG. 10 is an exploded perspective view of a pad holder 160 including a frictional pad according to an embodiment of the present invention, FIG. 11 is a perspective view illustrating an inside of a groove where the pad holder 160 of FIG. 10 is inserted, and FIG. 12 is a perspective view illustrating the structure of the groove where a shaft of FIG. 5 is supported.

Referring to FIGS. 10 and 11, the pad holder 160 includes a saddle part 162 on top of which a rubber pad 163 is mounted, and a slanted part 164. A tension part 165 is formed at both sides of the slanted part 164, and a hinge protrusion 170 is formed on each end of the tension part 165. A hinge groove 181 to which the hinge protrusion 170 is coupled is formed in a pad holder groove 180. A plastic sheet 166, e.g., polycarbonate sheet, is attached on the top of the slanted part 164 such that a front end of a document is prevented from contacting the rubber pad 163 directly. The rubber pad 163 is made of silicon rubber, and a lower portion of the rubber pad 163 is strongly attached on the saddle part 162 using an adhesive. Thus, in order to replace the rubber pad 163 with another one, all components of the pad holder 160 have to be replaced.

A boss (167 of FIG. 6) is formed downwardly from the bottom of the saddle part 162 of the pad holder 160. A boss 183 corresponding to the boss 167 is formed in the pad holder groove 180. An elastic spring 172 is coupled between the bosses 167 and 183 such that the pad holder 160 is supported to be elastically biased.

Meanwhile, as shown in FIG. 12, a fixed bushing 204 is installed on at least one end of the shaft 201 of the feeding roller 230. A handle 204*a* is formed at the fixed bushing 204, and one side of the fixed bushing 204 is D-type cut 204*b*. The D-type cut 204*b* is inserted in a lengthwise direction into a support groove 206 formed at one side of the ADF 100 and prevented from detaching from the support groove 206 if the handle 204*a* is rotated.

However, the slanted part 164 of the pad holder 160 is arranged between the pickup roller 250 and the feeding roller 230 so that the front end of the document hits the slanted part 164 and is passed over the slanted part 164. Thus, since the front end of the document picked-up by the pickup roller 250 hits the slanted part 164, is passed over the slanted part 164, and engages with the feeding roller 230, if the document is not the topmost sheet, it is difficult for the front end of the document to pass over the slanted part 164 and be engaged with the feeding roller 230. In addition, the rubber pad 163 serves to prevent double feeding. Thus, the ADF 100 having the above structure is effective to prevent double feeding.

In the ADF 100 having the above structure, the operation of coupling the pad holder 160 to the pad holder groove 180 will be described in detail with reference to the accompanying drawings.

First, the rubber pad 163 is glued on the saddle part 162, the plastic sheet 166 is glued on the slanted part 164, and the elastic spring 172 is installed on the boss 167 formed on the bottom of the pad holder 160. Subsequently, in order to insert the pad holder 160 into the pad holder groove 181, the tension parts 165 at both sides of the slanted part are pressed in a direction to face each other, and the hinge protrusion 170 is inserted into the hinge groove 181. In this case, one end of the elastic spring 172 is inserted into the boss 183 formed in the pad holder groove 180. Subsequently, after one end of the shaft 201 of the feeding roller 230 is inserted into a support hole (not shown) formed on a sidewall of the ADF 100, the D-type cut 204*b* is inserted into the support groove 206, and the handle 204*a* of the fixed bushing 204 is rotated clockwise so that the shaft 201 of the feeding roller 230 is fixed to the ADF 100. Subsequently, the maintenance cover 140 is closed, thereby completing the coupling process.

Next, the operation of replacing the pad holder 160 with another one after the rubber pad 163 is worn out, will be described.

First, after the cover 140 is opened, the handle 204*a* of the fixed bushing 204 is rotated counterclockwise, the D-type cut 204*b* is detached from the support groove 206 and the pickup assembly 200 is lifted from the ADF 100. If the tension parts 165 are pressed in a direction to face each other, the hinge protrusion 170 is detached from the hinge groove 181. Then, if the pad holder 160 is lifted upwardly, the pad holder 160 is easily separated from the ADF 100.

As described above, in the automatic document feeder (ADF) according to the present invention, double feeding of documents is prevented, and a user can easily replace a worn-out frictional pad with another one.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An automatic document feeder comprising:

a platen cover which covers a copying region;

a document tray which is provided on the platen cover and on which a document fed to the copying region is stacked;

a pickup assembly which includes a pickup roller that picks up the document stacked on the document tray and transfers the document to a feed path, and a feeding roller that receives the document picked-up by the pickup roller and allows the document to enter the feed path and which pivots the pickup roller centering on a shaft of the feeding roller by a predetermined distance according to a rotating direction of the shaft of the feeding roller; and a pad holder, including a frictional pad, which is installed in a pad holder groove formed at a region corresponding to the feeding roller in the tray to support the frictional pad installed to contact the feeding roller;

wherein an opposite portion of the pad holder to a portion supporting the frictional pad comprises one or more tension parts so that the pad holder is detachably hinge-coupled to the pad holder groove, and a biasing member is installed between a rear side of the pad holder contacting the frictional pad and the pad holder groove to bias the frictional pad towards the feeding roller.

2. The automatic document feeder of claim 1, further comprising a hanging protrusion formed on a front end of the pad holder, wherein a pivoting position of the hanging protrusion is regulated upwardly by a hanging groove formed in a portion of the pad holder groove corresponding to the hanging protrusion.

3. The automatic document feeder of claim 1, further comprising:

hinge protrusions formed at respective sides of a rear end of the pad holder; and hinge grooves formed at respective sides corresponding the hinge protrusions, wherein the hinge-coupling is performed by the hinge protrusions and the respective hinge grooves.

4. The automatic document feeder of claim 3, further comprising the one or more tension parts respectively formed at both sides of the pad holder, wherein the hinge protrusions are formed on the outward surfaces of the respective tension parts.

5. The automatic document feeder of claim 1, further comprising a slanted part, formed on the pad holder, which guides the picked-up document to enter between the frictional pad and the feeding roller.

6. The automatic document feeder of claim 5, further comprising a plastic sheet installed on the surface of the slanted part.

7. The automatic document feeder of claim 1, further comprising:

bushings which are respectively installed at both sides of the shaft of the feeding roller; and support grooves to support the bushings;

wherein at least one bushing has a D-type cut, the D-type cut enters only in a lengthwise direction into the corresponding support groove, and the D-type cut is locked inside the support groove when the D-type cut is rotated.

8. An automatic document feeder (ADF), including a platen cover covering a copying region and a document tray on the platen cover and on which a document fed to the copying region is stacked, comprising:

a pickup roller to pick up the document stacked on the document tray and to transfer the document to a feed path;

a feeding roller to receive the document picked-up by the pickup roller and to allow the document to enter the feed path;

a shaft, on which the feeding roller is centrally mounted, to pivot the pickup roller;

a pad holder, in a pad holder groove formed in the tray at a region which corresponds to a location of the feeding roller, including an end having a frictional pad attached thereto and another end comprising one or more tension parts so that the pad holder is detachably hinge-coupled to the pad holder groove, to support the frictional pad to be in contact with the feeding roller; and a biasing member between a rear side of the pad holder contacting the frictional pad and the pad holder groove to bias the frictional pad towards the feeding roller.

9. The automatic document feeder according to claim 8, further comprising:

a hanging protrusion on the front end of the pad holder; and a hanging groove to lock the hanging protrusion, wherein the locked hanging protrusion regulates a pivoting force of the pad holder caused by the biasing member.

10. The automatic document feeder according to claim 8, further comprising:

a hinge protrusion at the hinge-coupled end of the pad holder; and a hinge groove, to which the hinge protrusion is coupled.

11. The automatic document feeder according to claim 10, wherein the one or more tension parts bias the hinge protrusion in the hinge groove.

12. The automatic document feeder according to claim 8, further comprising a slanted part, formed on the pad holder, to guide the picked up document toward the feeding roller.

13. The automatic document holder according to claim 12, further comprising a plastic sheet on a top of the slanted part to prevent a front end of the document from contacting the frictional pad.

14. The automatic document holder according to claim 12, wherein the document is passed over the slanted part and engages with the feeding roller.

15. The automatic document holder according to claim 13, wherein the plastic sheet is made of a polycarbonate.

16. The automatic document holder according to claim 8, wherein the frictional pad is made of silicon rubber.

17. The automatic document holder according to claim 8, wherein the pad holder further comprises a saddle part in which the frictional pad strongly adheres to.

18. An automatic document feeder (ADF), including a tray on which a document is held, the ADF comprising:

a bi-directionally rotatable shaft to transfer power to the ADF;

a first roller to transfer the document to a feed path when the shaft rotates in a first direction;

a clutch to rotate the first roller away from the document when the shaft rotates in a second direction and to allow the first roller to rotate back to the document when the shaft resumes rotating in the first direction;

a second roller to receive the picked-up document and to allow the document to enter the feed path;

a pad holder, including a first end having a frictional pad attached to a first side thereof so as to oppose the second roller, and a second end comprising one or more tension parts so that the pad holder is detachably hinge-coupled to the tray at a region corresponding to the second roller; and a biasing member between a second side of the pad holder and the tray to bias the frictional pad towards the second roller.

* * * * *